US005139159A

United States Patent [19]

Daugherty, Jr. et al.

[11] Patent Number: 5,139,159

[45] Date of Patent: Aug. 18, 1992

[54] CONNECTING PIN FOR ARTICULATED COUPLING ARRANGEMENT

[75] Inventors: David W. Daugherty, Jr., Bolingbrook; Wajih Kanjo, Lockport, both of Ill.; Michael G. Hawryszkow, Munster, Ind.; William D. Wallace, Chicago, Ill.; Edward G. Lynch, Jr., Saugus, Calif.

[73] Assignee: Westinghouse Air Brake Company, Wilmerding, Pa.

[21] Appl. No.: 588,578

[22] Filed: Sep. 26, 1990

[51] Int. Cl.[5] ..... B61G 5/02

[52] U.S. Cl. ..... 213/75 R; 105/4.1

[58] Field of Search ..... 213/62 A, 72, 75 R, 213/86, 87, 98, 99, 188, 192, 197, 198, 199; 105/3, 4.1, 4.2, 189, 228, 226; 280/504, 515

[56] References Cited

U.S. PATENT DOCUMENTS

| | | | |
|---|---|---|---|
| 655,078 | 7/1900 | Harrison | 213/197 |
| 1,847,806 | 3/1933 | Banshak | 213/192 X |
| 1,920,415 | 8/1933 | Martin | 105/189 X |
| 2,815,865 | 12/1947 | Pelikan | 213/72 X |
| 3,396,673 | 8/1968 | Livelsberger et al. | 105/189 X |
| 3,721,482 | 3/1973 | Tack et al. | 105/4.1 X |
| 3,771,465 | 11/1973 | Glenn | 105/228 X |
| 4,258,628 | 3/1981 | Altherr | 105/4 R |
| 4,336,758 | 6/1982 | Radwill | 105/4.1 |
| 4,483,254 | 11/1984 | Meadows | 105/189 X |
| 4,593,829 | 6/1986 | Altherr | 213/75 R |
| 4,867,071 | 9/1989 | Weber | 105/4.1 |
| 4,962,861 | 10/1990 | Wiebe | 105/4.1 X |
| 5,005,715 | 4/1991 | Solomon | 213/62 A |
| 5,014,626 | 5/1991 | Schultz | 105/3 X |

FOREIGN PATENT DOCUMENTS 1200337 9/1965 Fed. Rep. of Germany .... 213/75 R

OTHER PUBLICATIONS

Maintenance Manual for ASF Articulated Connection Assembly, Jan. 1986.

*Primary Examiner*—Johnny D. Cherry
*Assistant Examiner*—Joseph D. Pape
*Attorney, Agent, or Firm*—J. O. Ray, Jr.

[57] ABSTRACT

This invention provides a connecting pin member which facilitates a rotatable connection being achieved between a female connection member and a center bowl portion of a bolster. Such connecting pin member has a substantially round rod-like member which is tapered at each outer end thereof. A groove-like portion carrying a resilient member is disposed in an outer surface of such rod-like member. The present invention further provides a method of producing such connecting pin member as well as an improved center plate member for use with such connecting pin member. Such center plate member incorporates an arrangement for the removal of such connecting pin member if it should be accidently sheared off during service.

38 Claims, 1 Drawing Sheet

CONNECTING PIN FOR ARTICULATED COUPLING ARRANGEMENT

FIELD OF THE INVENTION

The present invention relates, in general, to articulated type coupling arrangements used to connect a predetermined end of a first railway car body member to an adjacent predetermined end of a second railway car body member and, more particularly, the present invention relates to a connecting pin member engageable with the female connection member of an articulated coupling arrangement and center plate bowl disposed on the bolster portion of a railway car truck to removably and rotatably secure such articulated coupling arrangement to such railway car truck.

BACKGROUND OF THE INVENTION

Prior to the present invention, it is well known in today's modern railroad industry that couplers are used to connect adjacently disposed ends of a pair of railway cars together. Further, on any of these railway cars which may possibly be used in interchange type service, these standard couplers must have received approval by the Association of American Railroads (AAR) prior to their being installed on such ends of the railway cars.

It is generally well recognized, in the railroad industry, that such couplers will be required to serve a number of functions in this application. For example, such couplers are used to facilitate the connection and the unconnecting of individual railway cars to and from, respectively, a train consist. Another function served by these couplers is that they enable such individual railway cars to more easily negotiate the curved portion of the track which will be encountered during operation of the train on the track structure. Additionally, such standard couplers perform the function of allowing such railway cars to be easily and readily combined thereby making up a train consist. These standard couplers further permit such adjacent ends of the railway cars to be easily and readily separated into individual cars as necessary for either loading or unloading cargo thereto or therefrom, respectively.

In more recent times, however, in the railroad industry it has come to be generally recognized that a significant number of relatively important advantages can be achieved by the interconnection of a number of railway cars to form a substantially semi-permanent unit. This has been particularly the situation, for example, where such railway cars are specifically designed for use in what is commonly referred to in the railroad industry as "piggyback" or intermodal service. One of the primary reasons for this is that the cargo which is to be either loaded or unloaded is either brought to or removed from, respectively, predetermined central locations. Generally, such central locations are usually owned and operated by the railroads. This cargo is normally either over-the-road trailers or large containers which usually are used to ship cargo by oceangoing vessels.

The individual railway cars which have been connected together in this substantially semi-permanent manner are commonly known in the railroad industry as a "10-pack". Except at the extreme outermost ends of each 10-pack unit, the use of such standard couplers discussed above is not required on these 10-pack units. Because of their dedicated service, these 10-pack units will generally only be broken apart on a periodic basis. This is the primary reason why such standard couplers are not required in this particular application. In most cases, for example, the breaking of these 10-pack units will normally only occur when some maintenance must be carried out on either an individual coupler component or on certain other critical components positioned on the railway car which will require an individual car to be removed from such 10-pack unit on a temporary basis. In the railroad industry, it has become quite obvious that with the use of some type of semi-permanent coupling arrangement it is possible for them to achieve a rather significant reduction in their operating and maintenance costs. These cost reductions can be attributed to a variety of reasons. At a minimum, these reasons include a significant reduction in the weight of the railway equipment. Such weight reduction results in a rather significant reduction in the amount of energy required to move a train consist over the track structure. Because in this semi-permanent coupling arrangement fewer railway trucks are required, there is not only a reduction in equipment costs achieved but this also results in a reduction of the maintenance requirements.

Now, however, with the relatively extensive use of such substantially semi-permanent coupling arrangement, the railroad industry in conjunction with the railway equipment suppliers have determined that it is of critical importance for a close-buttoned relationship to be maintained between the couplers draft components present in a particular coupling arrangement. Further contributing to the importance of this close-buttoned relationship requirement is the ever increasing loads which must be carried by modern railway cars and train consists in order for the railroads to be competitive. This close-buttoned relationship has been found necessary, for example, so that the detrimental effects of the impact forces which are normally encountered during in-track train operation can be reduced to an acceptable level. In this manner, the possible damage that could be incurred by the cargo and/or the railway equipment can be held to an absolute minimum. Such impact forces are generally encountered during normal buff operation of the train consist.

With the above discussion in mind, attention is now directed to a particular prior art type articulated coupling arrangement used for the purpose of connecting adjacent ends of a pair of railway cars together in such semi-permanent fashion. This prior art articulated coupling arrangement is taught in U.S. Pat. No. 4,258,628. As has been illustrated therein, this particular articulated coupling apparatus includes a male connection member and a female connection member. The male connection member is secured at one end thereof to one end of a first railway car body member and the female connection member is secured at one end thereof to an adjacent end of a second railway car body member.

The female connection member, in this prior art coupling arrangement, is rotatably engaged in a center plate bowl portion of the bolster member positioned intermediate the side frames of the railway truck member. Such rotatable-type engagement is accomplished in a manner that is generally well known in the railway art. The outer end portion of the male connection member is disposed for relative movement, at the outer end portion of such female connection member.

A pin member is utilized in this coupling arrangement to connect the outer end portion of the male connection member within the cavity of such female connection member together thereby forming such substantially semi-permanent coupling. This pin member is positioned in a vertical plane. Additionally, this pin member is positioned in aligned apertures which are formed in each of such male connection member and such female connection member. It is of significance to note that, as is taught in this prior art reference, the aperture formed in such male connection member for receiving such pin member therein must be formed somewhat larger than such pin member itself. In this coupling arrangement, this is necessary to permit certain movements that are required of the coupling apparatus during service.

It should additionally be noted that a rear surface portion of such apertures formed in such male connection member and which will receive such pin member therein includes a horizontally disposed concave configuration and a vertically disposed convex configuration. This particular configuration is desirable in this coupling arrangement in order for both the male connection member and the female connection member to be able to move in each of a horizontal direction and a vertical direction with respect to one another. Another substantial area of surface contact between the rear surface of such pin aperture and the pin member itself is provided by this configuration at the same time.

Such male connection member, adjacent the outer end surface of the outer end portion thereof, includes a convex configuration. This convex configuration on the outer end surface of such male connection member abuttingly engages a complimentary concave surface which is formed on a front face portion of a follower member. As illustrated, in this coupling arrangement, this follower member is disposed within the rear portion of such cavity located in the outer end portion of such female connection member. This follower member, on the rear face portion thereof, includes a pair of vertically disposed slot-like cavities formed therein. A first portion of a resilient member is positioned within each of these vertically disposed slot-like cavities. Each such resilient member includes a second portion which extends outwardly from the rear face portion of such follower member. In this manner, a vertically disposed wedge-like element can be engaged with the exposed outermost surface area of each such resilient element. Such wedge-like element being a necessary component so that during service of this coupling arrangement such follower member and the male connection member can be urged forwardly. Consequently, the rear surface portion of the aperture formed in such outer end portion of the male connection member will be maintained substantially in mating engagement with such pin member at all times. In this coupling arrangement, because the majority of the articulated connecting members used are normally manufactured as cast components, such mating engagement being maintained between such pin members and the rear surface portion of this aperture disposed in the male connection member is essential. Furthermore, in attempting to maintain the manufacturing costs of this coupling arrangement as low as possible, such cast connecting components will normally receive very little, if any, finish machining necessary to provide either the required or the desirable dimensional control. In other words, these cast connecting members will generally be used as cast. As a result of this manufacturing cost-saving practice, it is quite often difficult to provide an articulated coupling apparatus that will be self-adjusting under the various wear conditions which such coupling apparatus will normally be subjected to during operation. It is important, nevertheless, to minimize as much as possible the slack encountered in the various coupling connections during such in track service.

Other prior art type coupling devices are taught in U.S. Pat. No. 3,716,148 and Canadian Patent Number 1,231,078.

SUMMARY OF THE INVENTION

In a first aspect of the present invention there is provided a connecting pin member which facilitates a rotatable connection being achieved between a female connection member of an articulated coupling arrangement and a center plate bowl portion of a bolster member, such bolster member being disposed between a pair of side frame members of a railway car truck. This connecting pin member includes an elongated and substantially round rod-like member. Such rod-like member has both a predetermined length and a predetermined diameter. A first tapered portion is disposed on this rod-like member adjacent a bottom first end thereof. Such first tapered portion has a predetermined taper which extends upwardly and outwardly from the bottom surface of the rod-like member. There is a second tapered surface disposed on such rod-like member that is located adjacent an axially opposed top second end thereof. This second tapered portion also has a predetermined taper. Such predetermined taper of the top second end extends downwardly and outwardly from the top surface of such rod-like member. Additionally, a groove-like portion is formed in the outer peripheral surface of such rod-like member. Such groove-like portion is positioned adjacent the top second end of the rod-like member. This groove-like portion has a predetermined width and a back wall that has a third tapered portion. Such third tapered portion on the back wall of such groove-like portion has a predetermined taper which starting at an upper wall of the groove-like portion extends downwardly and inwardly towards a bottom wall of this groove-like portion. The groove-like portion has a resilient member disposed therein. At least a portion of an outer surface of such resilient member will matingly engage at least a portion of a peripheral surface of a bore that is located substantially in the geometric center of a center plate member adjacent a bottom surface thereof, such center plate member being disposed on such female connection member.

According to a second aspect of the present invention there is provided a method of producing a connecting pin member having a first portion thereof disposable in a bore formed in a center plate member of a female connection member of an articulated coupling apparatus and a second portion thereof which will be disposed in a bore formed in a center plate bowl portion of a railway car truck bolster.

The method of producing such connecting pin member includes the steps of:

(a) determining each of a required length and a required diameter of an elongated substantially round rod-like member;

(b) determining a taper of a first tapered portion to be formed on such rod-like member adjacent a bottom first end thereof, such taper extending upwardly and outwardly from a bottom surface of such rod-like member;

(c) determining a taper of a second tapered portion to be formed on such rod-like member adjacent a top second end thereof, such taper of this second tapered portion extending downwardly and outwardly from a top surface of such rod-like member;

(d) determining a width of a groove-like portion to be formed in an outer peripheral surface of such rod-like member;

(e) determining a taper to be formed on a back wall of such groove-like portion, the taper on such back wall of this groove-like portion extending downwardly from a top wall of the groove-like portion and inwardly toward a bottom wall thereof;

(f) determining the position on such outer peripheral surface of such rod-like member which is to receive the groove or groove-like portion;

(g) determining a durometer or durometer hardness number for a resilient member to be disposed in such groove-like portion;

(h) cutting a substantially round rod having a diameter equal to the diameter of the rod-like member determined in step {a} to the required length also determined in step {a};

(i) forming the first tapered portion on the bottom first end of such rod-like member to such taper determined in step {b};

(j) forming the second tapered portion on the top second end of such rod-like member to such taper determined in step {c};

(k) forming the groove or groove-like portion in such outer peripheral surface of such rod-like member at the position determined in step {f} to the width determined in step {d} and having the taper determined in step {e}; and (l) positioning the resilient member having such durometer hardness determined in step {g} within the groove-like portion formed in step {k}.

A final aspect of the present invention provides an improved center plate member which is disposed on the female connection member of the articulated coupling arrangement which incorporates therein both a connecting pin member and an arrangement to quickly remove such connecting pin member if it should become sheared off during service. Such improved center plate member includes a substantially round plate member which is disposed on a bottom wall of a cavity which is located in an outer end of the female connection member. This plate member has both a predetermined diameter and a predetermined height. A vertically disposed bore is formed substantially in the geometric center of such plate member adjacent the bottom surface thereof. This bore has both a predetermined length and predetermined diameter. A connecting pin member is provided. A first top end portion of such connecting pin member extends into such bore formed in the plate member. Such connecting pin member includes an elongated substantially round rod-like member. This rod-like member has both a predetermined length and predetermined diameter. A first tapered portion is disposed on such rod-like member adjacent such first top end portion thereof. Such first tapered portion has a predetermined taper which extends downwardly and outwardly from a top surface of the rod-like member. A second tapered portion is disposed on such rod-like member adjacent such bottom second end portion thereof. This second tapered portion has a predetermined taper which extends upwardly and outwardly from the bottom surface of the rod-like member. A groove or groove-like portion is formed in an outer peripheral surface of such rod-like member. This groove-like portion is located adjacent such first top end of such rod-like member. The groove-like portion has a predetermined width and a back wall which has third tapered portion. Such third tapered portion of this back wall of the groove-like portion has a predetermined taper which starting at the juncture of a top wall and the back wall of such groove-like portion extends downwardly and inwardly toward the juncture of the bottom wall and the back wall of such groove-like portion. A resilient member, having a predetermined durometer or durometer hardness number, is disposed in such groove-like portion of the rod-like member. At least a portion of an outer surface of such resilient member matingly engages at least a portion of the surface of such bore formed in the plate member. In the event such connecting pin member should be sheared off adjacent the bottom surface of the plate member a means is provided which will facilitate removal of the top portion of the connecting pin member remaining in such bore formed in the plate member.

OBJECTS OF THE INVENTION

It is, therefore, one of the primary objects of the present invention to provide a connecting pin for an articulated coupling arrangement which enables the necessary rotatable connection of the female connection member within the center plate bowl located on the bolster portion of a railway car track to be easily and readily accomplished.

Another object of the present invention is to provide a connecting pin for an articulated coupling arrangement which, when compared to the connecting pins presently in use in this application, will be relatively lighter in weight.

Still another object of the present invention is to provide a connecting pin for an articulated coupling arrangement which is relatively easy to install.

Yet another object of the present invention is to provide a connecting pin for an articulated coupling arrangement which during normal service in this application will generally require a minimum of maintenance.

A further object of the present invention is to provide a connecting pin for an articulated coupling arrangement which can be readily manufactured from substantially off-the-shelf bar stock having a predetermined diameter.

A additional object of the present invention is to provide a connecting pin for an articulated coupling arrangement which can tolerate a rather wide range of durometers or durometer hardnesses in the resilient member portion of such connecting pin simply by changing the taper of the back wall portion of the groove-like portion provided in the outer surface of the connecting pin to receive such resilient member therein.

Still yet another object of the present invention is to provide a connecting pin for an articulated coupling arrangement which includes an O-ring resilient member that can be positioned in mating engagement with a bore formed in a center plate portion of the female connection member adjacent the bottom surface thereof which is disposed in such center plate bowl on such bolster.

Yet still another object of the present invention is to provide a connecting pin for an articulated coupling arrangement which will not add significantly to the production cost of such articulated coupling arrangement.

It is another one of the primary objects of the present invention to provide a method of producing a connecting pin for use in an articulated coupling arrangement which will permit a relatively wide range of durometers to be used for the resilient member portion of such connecting pin by the selection of a proper taper of back wall of a groove-like portion disposed in the outer surface of such connecting pin which receives such resilient member therein.

Another object of the present invention is to provide a method of producing a connecting pin for use in an articulated coupling arrangement which will permit a relatively wide range of tapers to be used on a back wall of a groove-like portion formed in an outer surface of such connecting pin by the selection of a proper durometer or durometer hardness for a resilient member to be disposed in such groove-like portion of the connecting pin.

Still another object of the present invention is to provide a method of producing a connecting pin for use in an articulated coupling arrangement in which the sequence of steps required to carry out such method can be varied as desired.

It is still another one of the primary objects of the present invention to provide an improved center plate member disposed on a female connection member of an articulated coupling arrangement which includes an improved connecting pin and an arrangement which will enable a quick removal of such connecting pin should it be sheared off adjacent the bottom surface of such center plate member during service.

A additional object of the present invention is to provide an improved center plate member for use on an articulated coupling arrangement in which the removal of a sheared connecting pin can be accomplished without disassembly of the entire articulated coupling arrangement.

In addition to the specific objects and advantages of the present invention which have been described in detail above, various other objects and advantages of such invention will become more readily apparent to those persons who are skilled in the railway art from the following more detailed description of the invention, particularly, when such description is taken in conjunction with the attached drawings and with the appended claims.

BRIEF DESCRIPTION OF THE INVENTION

Figure 1:
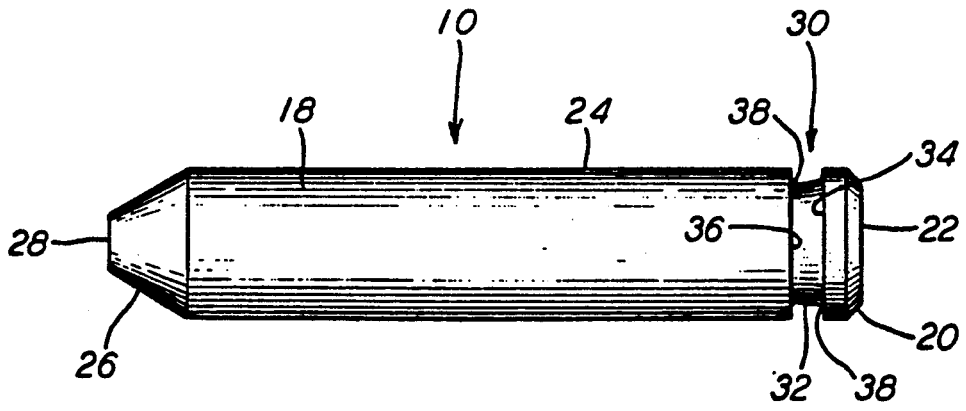
FIG. 1 is a side elevation view which illustrates one presently preferred embodiment of a connecting pin for an articulated coupling arrangement produced according to the present invention.

Prior to proceeding to the more detailed description of the numerous embodiments of the present invention, it should be noted that in each of the views illustrated in the drawings identical components which have identical functions have, for the sake of clarity, been identified with identical reference numerals.

Figure 2:
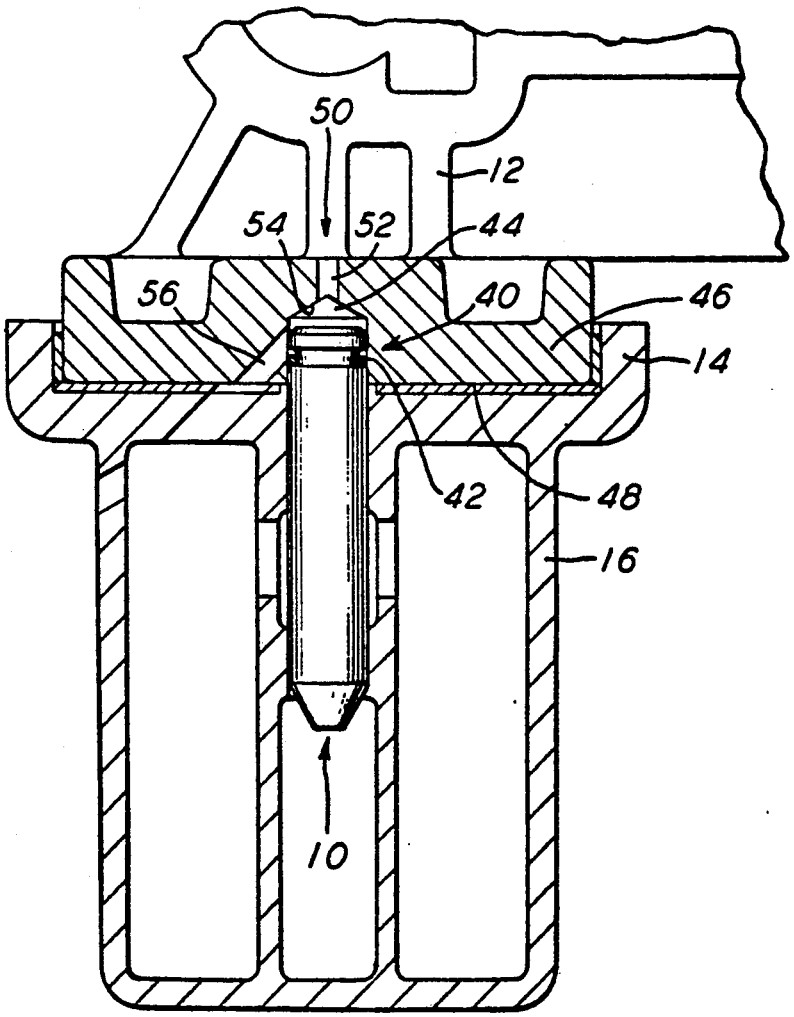
FIG 2 is a fragmented side elevation view, partially in cross-section, which illustrates a presently preferred embodiment of an improved center plate member disposed on a female connection member of an articulated coupling arrangement which incorporates therein both the connecting pin illustrated in FIG. 1 and an arrangement to remove such connecting pin if it becomes sheared off during service.

Now refer more particularly to FIGS. 1 and 2, wherein there is illustrated a connecting pin member, generally designated 10, which facilitates a rotatable connection being achieved between a female connection member 12 of an articulated coupling arrangement (not shown) and the center bowl portion 14 of a bolster member 16 disposed between a pair of side frames (not shown) of a railway car truck (not shown). This connecting pin member 10 comprises an elongated rod-like member 18. Such rod-like member 18 is substantially round in cross-section and has both a predetermined length and a predetermined diameter. The predetermined length of such rod-like member 18 generally will be in a range of between about 8.75 inches and about 9.25 inches. The diameter of such rod-like member 18 generally will be in a range of between about 1.73 inches and about 1.77 inches with the most preferred diameter being about 1.75 inches.

A first tapered portion 20 is disposed on the rod-like member 18 adjacent the top first end thereof. Such first tapered portion 20 having a predetermined taper which extends downwardly from a top surface 22 of the top first end and outwardly towards an outer peripheral surface 24 of such rod-like member 18. The predetermined taper of this first tapered portion 20 will generally be in a range of between about 40.0 degrees and about 50.0 degrees with respect to a longitudinal axis of such connecting pin member 10 and the surface 22 of the top first end of such connecting pin member 10. Preferably such predetermined taper of the first tapered portion 20 will be in a range of between about 44.0 degrees and about 46.0 degrees. Also disposed on such rod-like member 18 adjacent a bottom second end thereof is a second tapered portion 26. Such second tapered portion 26 having a predetermined taper which extends upwardly from a bottom surface 28 of such bottom second end of the rod-like member 18 and outwardly towards such outer peripheral surface 24 thereof. The predetermined taper of such second tapered portion 26 generally will be in a range of between about 70.0 degrees and about 80.0 degrees with respect to such longitudinal axis of the connecting pin member 10 and such bottom surface 28 of the rod-like member 18. A more preferred range for such predetermined taper of the second tapered portion 26 is between about 74.0 degrees and about 76.0 degrees. The connecting pin member 10 includes a groove or groove-like portion, generally designated 30, which is formed in the outer peripheral surface 24 of such rod-like member 18 adjacent the top first end of the rod-like member 18. The groove-like portion 30 has a predetermined width and a back wall 32 which has a third tapered portion. This third tapered portion of the back wall 32 has a predetermined taper which from a junction of a top wall 34 of such groove-like portion 30 and the back wall 32 extends downwardly towards a junction of a bottom wall 36 of the groove-like portion 30 and such back wall 32 and inwardly towards such longitudinal axis of such connecting pin member 10. The predetermined taper of such back wall 32 of the groove-like portion 30 is critical, as will become clear as the description of the invention proceeds. Generally, the predetermined taper of such back wall 32 of the groove-like portion 30 will be in a range of between about 3.0 degrees and about 8.0 degrees. The predetermined width of such groove-like portion 30 generally will be in the range of between about 0.365 inch and about 0.385 inch. A more preferred width of such groove-like portion 30 will be in the range of between about 0.36 inch and about 0.38 inch. Further, in accordance with the presently preferred embodiment of the invention each of the junctions between such top wall 34 and such back wall 32 of the groove-like portion 30 and the junction between such bottom wall 36 and the back wall 32 of the groove-like portion 30 includes a radius portion 38. Generally the radius of such radius portion 38 will be in a range of between about 0.06 inch and about 0.065 inch. In addition, in this embodiment of the present invention, the top wall 34 of the groove-like portion 30 will be positioned at least about 0.45 inch from the top surface 22 of such connecting pin member 10 and no more than about 0.675 inch from such top surface 22.

A resilient member, generally designated 40, is disposed within the groove-like portion 30 in a position intermediate the top wall 34 and the bottom wall 36 thereof. Such resilient member 40 being free to move up and down the back wall 32 of such groove-like portion 30. An inner surface of such resilient member 40 is engaged with such third tapered portion of the back wall 32 and a outer surface of the resilient member 40 is engageable with a surface 42 of a bore 44 formed in a center plate member 46 disposed on such female connection member 12. The resilient member 40 has a predetermined durometer or durometer hardness number which generally will be in a range of between about 70 and about 100. We have discovered that the taper of the back wall 32 of the groove-like portion 30 and the durometer or durometer hardness of such resilient member 40 are correlated. Such correlation is such that as the durometer or durometer hardness as indicated by the durometer hardness number of the resilient member 40 is increased the taper of such back wall 32 of the groove-like portion 30 must be decreased. In the preferred arrangement of the invention, the predetermined durometer hardness number of the resilient member 40 will usually be in a range of between about 70 and about 80 and the predetermined taper of the back wall 32 of such groove-like portion 30 will then be in a range of between about 6.5 degrees and about 7.5 degrees. It is presently preferred for such resilient member 40 to be an O-ring.

The present invention includes a method of producing a connecting pin member 10 which is useful in the establishment of a rotatable-type connection between the female connection member 12 of an articulated coupling arrangement and a center bowl portion 14 of a bolster member 16 which is disposed intermediate a pair of side frame members of a railway car truck. Such method includes making a determination of each of a required length and a required diameter of an elongated substantially round rod-like member 18. The method, also, includes determining a taper of a first tapered portion 20 disposed on the rod-like member 18 adjacent a top first end thereof. This taper of such first tapered portion 20 is such that it extends downwardly from a top surface 22 of such top first end and outwardly towards an outer peripheral surface 24 of the rod-like member 18. Further, the method includes determining a taper of a second tapered portion 26 disposed on the rod-like member 18 adjacent a bottom second end thereof. The taper of this second tapered portion 26 is such that it extends upwardly from a bottom surface 28 of such bottom second end and outwardly towards such outer peripheral surface 24 of the rod-like member 18. Additionally, the method includes determining a width of a groove-like portion 30 which is to be formed in such outer peripheral surface 24 of the rod-like member 18. One of the critical steps involved in this method is determining a taper to be formed on a back-wall 32 of such groove-like portion 30. Such taper of the back wall 32 extends downwardly from a juncture of a top wall 34 of the groove-like portion 30 and such back wall 32 and inwardly towards a longitudinal axis of such rod-like member 18 terminating at a juncture of such back wall 32 and a bottom wall 36 of such groove-like portion 30. The method further includes making a determination of the position on such outer peripheral surface 24 of the rod-like member 18 that will receive such groove-like portion 30 therein. Another one of the critical steps in the present invention is determining the required durometer or durometer hardness number of a resilient member 40 which is to be positioned within such groove-like portion 30 intermediate the top wall 34 and the bottom wall 36 thereof. It should be noted at this point that any of the steps described thus far can be carried out in any desired order without departing from the scope of the present invention. Once the above-identified steps have been completed the next step in the preferred method involves cutting a substantially round rod having a diameter equal to the required diameter determined above to the required length determined above. Another step in the method of this invention is forming such first tapered portion 20 on the top first end of such rod-like member 18 to such taper determined above. Further, the method includes forming the second tapered portion 26 on such bottom second end of the rod-like member 18 to the taper previously determined desirable. In addition, such method includes forming the groove-like portion 30 in the predetermined position in such outer peripheral surface 24 of the rod-like member 18 to the predetermined width and having the taper on the back wall 32 determined necessary. It should be noted here that it is not critical as to which tapered portion 20 and 26 o the groove-like portion 30 is formed first. Instead it is within the scope of the present invention for them to be formed on such rod-like member 18 in any convenient order. The final essential step in the method is positioning the resilient member 40 having a requisite durometer determined previously within the groove-like portion 30 formed in such outer peripheral surface 24 of the rod-like member 18.

In the most preferred practice of the invention, the method includes the additional step of correlating such durometer of the resilient member 40 with the taper formed on the back wall 32 of such groove-like portion in a manner such that as the durometer of the resilient member 40 increases the angle of the taper of such back wall will be decreased. This additional step would at least be performed prior to positioning such resilient member 40 within such groove-like portion 30 on the rod-like member 18.

Finally, in the preferred method of the invention, such method includes the additional steps of first, determining a radius 38 to be formed at a juncture of the top wall 34 and the a back wall 32 of such groove-like portion and at a juncture of the bottom wall 36 and the back wall 32 of such groove-like portion; and, while forming such groove-like portion 30 forming such radius 38 at the aforesaid juncture.

According to the final aspect of the present invention, there is provided an improved center plate member 46 disposed on a bottom wall of a cavity (not shown) located at an outer end of a female connection member 12 which forms a part of a articulated coupling arrangement. The improved center plate member 46 incorporates therein both the connecting pin member 10 which facilitates a rotatable connection of such female connection member 12 in a center plate bowl portion 14 of a bolster portion 16 of a railway car truck (not shown) and an arrangement whereby the upper portion of the connecting pin member 10 can be quickly removed from such center plate member 46 if, during service, the connecting pin member 10 should be sheared off adjacent a bottom surface 48 of such center plate member 46.

Such improved center plate member 46 includes a substantially round plate-like member disposed beneath the bottom wall portion of the cavity located in such outer end portion of the female connection member 12. This plate-like member has a predetermined diameter that is slightly less than an inner diameter of such center plate bowl portion 14 of such bolster 16. Such plate-like member also has a predetermined height that is slightly greater than the depth of such center plate bowl portion 14.

A vertically disposed bore 44 is formed substantially in a geometric center of such plate-like member. The bore 44 has both a predetermined diameter and a predetermined length which starts adjacent the bottom surface 48 of such plate-like member. The connecting pin member 10 (as described in detail above) has a first top end thereof extending into the bore 44 formed in the center plate member 46.

A means, generally designated 50, engageable with or accessible with such connecting pin member 10 is provided to facilitate removal of such first top end of the connecting pin member 10 from the bore 44 in the plate-like member in the event such connecting pin member should be sheared off substantially adjacent the bottom surface 48 of the center plate member 46 during service. In one aspect of the present invention such means 50 for facilitating the removal of such first top end of the connecting pin member 10 from the bore 44 is heat which is applied to such first top end of such connecting pin member 10 in an amount and for a period of time that is at least sufficient to substantially destroy such resilient member 40. In this manner, once such resilient member 40 is destroyed the first top end of the connecting pin member 10 will drop out of such bore 44 in the center plate member 46. Another means 50 for facilitating such removal of the first top end of such connecting pin member 10 from the bore 44 formed in such center-plate member 46 is an aperture 52 formed through the bottom wall of such cavity disposed on such outer end of the female connection member 12. This aperture 52 is in communication with the upper surface 54 of the bore 44 and has a predetermined shape which is smaller than the predetermined diameter of such bore 44. Such aperture 52 enables engagement of the top surface 22 of such first top end of the connecting pin member 10 with a tool that is capable of pushing such first top end of such connecting pin member 10 out of such bore 44 for a distance at least sufficient to enable it to be easily removed with a pair of pliers, for example. The means 50 for facilitating the removal of such first top end of such connecting pin member 10 from the bore 44 in the center plate member 46 can be an aperture 56 formed in such plate-like member. In this case, the aperture 56 extends from the bottom surface 48 of the plate-like member 46 to a location on such bore 44 that is adjacent the groove-like portion 30 formed in the outer surface 24 of the connecting pin member 10. Such aperture 56 enables engagement of one of such resilient member 40 and the bottom wall 36 of such groove-like portion 30 with a tool capable of exerting a force on such first top end of the connecting pin member 10 that is at least sufficient to push such first top end downwardly to a point where it can be easily removed as described above.

While a number of the presently preferred and alterative embodiments of the present invention have been described in detail above, it should be obvious that persons who are skilled in the railway car coupling art that various other modifications and adaptations of the present invention are possible without departing from the spirit and scope of the appended claims.

We claim:

1. A connecting pin member which facilitates a rotatable connection being achieved between a female connection member of an articulated coupling arrangement and a center bowl portion of a bolster member disposed between a pair of side frame members of a railway car truck, said connecting pin member comprising:

(a) an elongated substantially round rod-like member having predetermined length and a predetermined diameter;

(b) a first tapered portion disposed on said rod-like member adjacent a top first end thereof, said first tapered portion having a predetermined taper which extends downwardly from a top surface of said top first end and outwardly towards an outer peripheral surface of said rod-like member;

(c) a second tapered portion disposed on said rod-like member adjacent a bottom second end thereof, said second tapered portion having a predetermined taper which extends upwardly from a bottom surface of said bottom second end and outwardly towards said outer peripheral surface of said rod-like member;

(d) a groove-like portion formed in said outer peripheral surface of said rod-like member and positioned adjacent said top first end of said rod-like member, said groove-like portion having a predetermined width and a back wall having a third tapered portion, said third tapered portion having a predetermined taper which from a juncture of a top wall of said groove-like portion and said back wall extends downwardly toward a juncture of a bottom wall of said groove-like portion and said back wall and inwardly toward a longitudinal axis of said rod-like member; and (e) a resilient member disposed in said groove-like portion intermediate said top wall and said bottom wall, an inner surface of said resilient member engageable with said third tapered portion of said back wall and an outer surface of said resilient member matingly engageable with at least a portion of a surface of a bore formed in a center plate member disposed on such female connection member, said resilient member having a predetermined durometer hardness; and (f) the angle of said taper of said back wall of said groove-like portion and said predetermined durometer hardness of said resilient member being correlated such that for a resilient member of a given durometer hardness the angle of said predetermined taper of said back wall will be greater than it will be for a resilient member of a greater durometer hardness.

2. A connecting pin member, according to claim 1, wherein said predetermined durometer hardness of said resilient member is indicated by a durometer hardness number in a range of between 70 and about 100.

3. A connecting pin member, according to claim 2, wherein said predetermined taper of said back wall of said groove-like portion is in a range of between about 3.0 degrees and about 8.0 degrees.

4. A connecting pin member, according to claim 3, wherein said predetermined durometer hardness of said resilient member is indicated by a durometer hardness number in a range of between about 70 and about 80 and said predetermined taper of said back wall of said groove-like portion is in a range of between about 6.5 degrees and about 7.5 degrees.

5. A connecting pin member, according to claim 4, wherein said resilient member is an O-ring.

6. A connecting pin member, according to claim 1, wherein said predetermined length of said rod-like member is at least about 8.75 inches.

7. A connecting pin member, according to claim 6, wherein said predetermined length of said rod-like member is between about 8.90 inches and about 9.0 inches.

8. A connecting pin member, according to claim 1, wherein said predetermined diameter of said rod-like member is between about 1.73 inches and about 1.77 inches.

9. A connecting pin member, according to claim 5, wherein said taper of said second tapered portion is between about 8.90 inches and about 9.0 inches and said predetermined diameter is about 1.75 inches.

10. A connecting pin member, according to claim 1, wherein said predetermined taper of said first taper portion is between about 40.0 degrees and about 50.0 degrees with respect to a longitudinal axis of said connecting pin member and said top surface of said top first end of said rod-like member.

11. A connecting pin member, according to claim 10, wherein said predetermined taper of said first tapered portion is between about 44.0 degrees and about 46.0 degrees.

12. A connecting pin member, according to claim 1, wherein said predetermined taper of said second tapered portion is between about 70.0 degrees and about 80.0 degrees with respect to a longitudinal axis of said connecting pin member and said bottom surface of said bottom second end of said rod-like member.

13. A connecting pin member, according to claim 12, wherein said predetermined taper of said second tapered portion is between about 74.0 degrees and about 76.0 degrees.

14. A connecting pin member, according to claim 5, wherein said predetermined taper of said first tapered portion is between about 44.0 degrees and about 46.0 degrees with respect to a longitudinal axis of said connecting pin member and said bottom surface of said bottom second end of said rod-like member.

15. A connecting pin member, according to claim 9, wherein said predetermined taper of said first taper portion is between about 40.0 degrees and about 50.0 degrees with respect to a longitudinal axis of said connecting pin member and said top surface of said top first end of said rod-like member and said predetermined taper of said second tapered portion is about 70.0 degrees and about 80.0 degrees with respect to said longitudinal axis of said connecting pin member and said bottom surface of said bottom second end of said rod-like member.

16. A connecting pin member, according to claim 5, wherein said predetermined width of said groove-like portion is between about 0.365 inch and about 0.385 inch.

17. A connecting pin member, according to claim 16, wherein said top wall of said groove-like portion is at least about 0.45 inch from said top surface of said top first end of said rod-like member.

18. A connecting pin member, according to claim 17, wherein said top wall of said groove-like portion is between about 0.45 inch and 0.675 inch from said top surface of said top first end of said rod-like member.

19. A connecting pin member, according to claim 18, wherein said predetermined width of said groove-like portion is between about 0.36 inch and about 0.38 inch.

20. A connecting pin member, according to claim 19, wherein each of said juncture of said top wall and said back wall of said groove-like portion and said juncture of said bottom wall and said back wall of said groove-like portion includes a radius portion.

21. A connecting pin member, according to claim 20, wherein said radius portion has a radius of between about 0.06 inch and about 0.065 inch.

22. A method of producing a connecting pin member useful in establishing a rotatable-type connection between a female connection member of an articulated coupling arrangement and a center bowl portion of a bolster member disposed intermediate a pair of side frame members of a railway car truck, said method comprising the steps of:

(a) determining each of a required length and a required diameter of an elongated substantially round rod-like member;

(b) determining a taper of a first tapered portion disposed on said rod-like member adjacent a top first end thereof, said taper of said first tapered portion extending downwardly from a top surface of said top first end and outwardly towards an outer peripheral surface of said rod-like member;

(c) determining a taper of a second tapered portion disposed on said rod-like member adjacent a bottom second end thereof, said taper of said second tapered portion extending upwardly from a bottom surface of said bottom second end and outwardly towards said outer peripheral surface of said rod-like member;

(d) determining a width of a groove-like portion to be formed in said outer peripheral surface of said rod-like member;

(e) determining a taper to be formed on a back wall of said groove-like portion, said taper of said back wall is to extend downwardly from a juncture of a top wall of said groove-like portion and said back wall and inwardly toward a longitudinal axis of said rod-like member;

(f) determining a position on said outer peripheral surface of said rod-like member which is to receive said groove-like portion;

(g) determining a durometer of a resilient member to be disposed in said groove-like portion;

(h) cutting a substantially round rod having a diameter equal to said required diameter determined in step (a) to said required length determined in step (a);

(i) forming said first tapered portion on said top first end of said rod-like member to said taper determined in step (b);

(j) forming said second tapered portion on said bottom second end of said rod-like member to said taper determined in step (c);

(k) forming said groove-like portion in said position on said outer peripheral surface of said rod-like member determined in step (f) to said width determined in step (d) and having said taper on said back wall determined in step (e); and (l) positioning said resilient member having said durometer determined in step (g) within said groove-like portion formed in said outer peripheral surface of said rod-like member in step (k).

23. A method of producing a connecting pin member, according to claim 22, wherein steps (a) through (g) can be performed in any desired order.

24. A method of producing a connecting pin member, according to claim 23, wherein steps (i) through (k) can be performed in any order.

25. A method of producing a connecting pin member, according to claim 24, wherein prior to step (l) said method includes an additional step of correlating said durometer of said resilient member with said taper formed on said back wall of said groove-like portion such that as said durometer of said resilient member increases said taper of said back wall decreases.

26. A method of producing a connecting pin member, according to claim 25, wherein prior to step (k) said method includes the additional steps of:

(a) determining a radius to be formed at a juncture of said top wall and said back wall of said groove-like portion and at a juncture of said bottom wall and said back wall of said groove-like portion; and (b) during step (k) forming said radius at said juncture of said top wall and said back wall of said groove-like portion and at said juncture of said bottom wall and said back wall of said groove-like portion.

27. An improved center plate member disposed on a female connection member of an articulated coupling arrangement which incorporates therein both a connecting pin member which facilitates a rotatable connection of such female connection member in a center plate bowl portion of a bolster portion of a railway car truck and an arrangement to quickly remove said connecting pin member if during service it should be sheared off adjacent a bottom surface of said center plate member, said improved center plate member comprising:

(a) a substantially round plate-like member disposed beneath a bottom wall portion of a cavity located in an outer end portion of such female connection member, said plate-like member having a predetermined outer diameter that is slightly less than an inner diameter of such center plate bowl portion of such bolster and a predetermined height that is slightly greater than a depth of such center plate bowl portion;

(b) a vertically disposed bore formed substantially in a geometric center of said plate-like member adjacent a bottom surface thereof, said bore having each of a predetermined length and a predetermined diameter;

(c) a connecting pin member having a first top end thereof extending into said bore, said connection pin member includes;

(i) an elongated substantially round rod-like member, said rod-like member having a predetermined length and a predetermined diameter, said predetermined diameter of said rod-like member being slightly less than said predetermined diameter of said bore formed in said plate-like member;

(ii) a first tapered portion disposed on said rod-like member adjacent a top first end thereof which is disposed within said bore in said plate-like member, said first tapered portion having a predetermined taper which extend downwardly from a top surface of said top first end and outwardly towards an outer peripheral surface of said rod-like member, (iii) a second tapered portion disposed on said rod-like member adjacent a bottom second end thereof which will be disposed within a cavity in such bolster during operation, said second tapered portion having a predetermined taper which extends upwardly from a bottom surface of said bottom second end and outwardly towards said outer peripheral surface of said rod-like member, (iv) a groove-like portion formed in said outer peripheral surface of sid rod-like member and positioned adjacent said top first end of said rod-like member, said wall having a third tapered portion, said third tapered portion having a predetermined taper which from a juncture of a top wall of said groove-like portion and said back wall extends downwardly towards a juncture of a bottom wall of said groove-like portion and said back wall and inwardly towards a longitudinal axis of said rod-like member, and (v) a resilient member disposed in said groove-like portion intermediate said top wall and said groove-like portion intermediate said top wall and said bottom wall thereof, at least a portion of an inner surface of said back wall of said groove-like portion and at least a portion of an outer surface of said resilient member engaging a portion of an inner surface of said bore formed in said plate-like member; and (d) a means engageable with said connecting pin member for facilitating removal of said first top end thereof from said bore in said plate-like member if said connecting pin member becomes sheared off adjacent said bottom surface of said plate-like member during service.

28. An improved center plate member, according to claim 27, wherein said means for facilitating removal of said first top end of said connecting pin member from said bore in said plate-like member is heat applied to said first top end of said connecting pin member in an amount at least sufficient to destroy said resilient member thereby enabling said first top end of said connecting pin member to drop out of said bore in said plate-like member.

29. An improved center plate member, according to claim 27, wherein said means for facilitating removal of said first top end o said connecting pin member from said bore in said plate-like member is an aperture formed through said bottom wall portion of said cavity located in said outer end of said female connection member, said aperture being in communication with an upper surface of said bore formed in said plate-like member and having a predetermined shape which is smaller than said predetermined diameter of said bore formed in said plate-like member, said aperture enabling engagement of said top surface of said first top end of said connecting pin member with a tool capable of pushing said first top end of said connecting pin member out of said bore.

30. An improved center plate member, according to claim 29, wherein said predetermined shape of said aperture is substantially round.

31. An improved center plate member, according to claim 27, wherein said predetermined taper of said back walls of said groove-like portion and said predetermined durometer of said resilient member are correlated such that as said durometer of said resilient member increases said predetermined taper of said back wall decreases.

32. An improved center plate member, according to claim 27, wherein said predetermined durometer of said resilient member is in a range of between about 70 and about 100.

33. An improved center plate member, according to claim 32, wherein said predetermined taper of said back wall of said groove-like portion is in a range of between about 3.0 degrees and about 8.0 degrees.

34. An improved center plate member, according to claim 33, wherein said predetermined durometer of said resilient member is in range of between about 70 and about 80 and said predetermined taper of said back wall of said groove-like portion is in a range of between about 6.5 degrees and about 7.5 degrees.

35. An improved center plate member, according to claim 34, wherein said resilient member is an O-ring.

36. An improved center plate member, according to claim 35, wherein said predetermined width of said groove-like portion is between about 0.365 inch and about 0.385 inch.

37. An improved center plate member, according to claim 36, wherein said top wall of said groove-like portion is at least about 0.45 inch from said top surface of said top first end of said rod-like member.

38. An improved center plate member, according to claim 37, wherein said predetermined width of said groove-like portion is between about 0.36 inch and about 0.38 inch.

* * * * *

UNITED STATES PATENT AND TRADEMARK OFFICE

CERTIFICATE OF CORRECTION

PATENT NO. : 5,139,159

DATED : August 18, 1992

INVENTOR(S) : David W. Daugherty, et al.

It is certified that error appears in the above-identified patent and that said Letters Patent is hereby corrected as shown below:

Column 4, line 40, delete "towards" and insert --toward--.

Column 6, line 2, after has, insert --a--;

Column 6, line 46, delete "a", insert --an--.

Column 7, line 4, after of, insert --a--.

Column 9, line 20, delete "a" and insert --an--.

Column 10, line 36, delete "o" and insert --on--;

Column 10, line 55, after of, insert --;--.

Signed and Sealed this

Sixteenth Day of November, 1993

*Attest:*

Bruce Lehman

BRUCE LEHMAN

*Attesting Officer*

*Commissioner of Patents and Trademarks*